US010005088B2

(12) United States Patent
Nirdosh et al.

(10) Patent No.: US 10,005,088 B2
(45) Date of Patent: Jun. 26, 2018

(54) FLOTATION OF SPHALERITE FROM MIXED BASE METAL SULFIDE ORES EITHER WITHOUT OR WITH LARGELY REDUCED AMOUNT OF COPPER SULFATE ADDITION USING 2-(ALKYLAMINO)ETHANETHIOLS AS COLLECTORS

(71) Applicant: Lakehead University, Thunder Bay (CA)

(72) Inventors: Inderjit Nirdosh, Thunder Bay (CA); Natarajan Ramanathan, Trichy (IN)

(73) Assignee: LAKEHEAD UNIVERSITY, Thunder Bay, ON (CA)

( * ) Notice: Subject to any disclaimer, the term of this patent is extended or adjusted under 35 U.S.C. 154(b) by 90 days.

(21) Appl. No.: 15/389,619

(22) Filed: Dec. 23, 2016

(65) Prior Publication Data

US 2017/0209873 A1 Jul. 27, 2017

Related U.S. Application Data

(60) Provisional application No. 62/281,872, filed on Jan. 22, 2016.

(51) Int. Cl.

| | |
|---|---|
| ***C22B 1/24*** | (2006.01) |
| ***B03D 1/01*** | (2006.01) |
| ***B02C 23/08*** | (2006.01) |
| ***C22B 3/00*** | (2006.01) |

(52) U.S. Cl.
CPC ..... *B03D 1/01* (2013.01); *B02C 23/08* (2013.01); *C22B 1/24* (2013.01); *C22B 3/00* (2013.01); *B03D 2201/02* (2013.01); *B03D 2203/02* (2013.01)

(58) Field of Classification Search
None
See application file for complete search history.

(56) References Cited

FOREIGN PATENT DOCUMENTS

| | | | |
|---|---|---|---|
| CA | 1084178 A | * | 8/1980 |
| CA | 1265876 A | * | 2/1990 |

* cited by examiner

*Primary Examiner* — Melissa S Swain
(74) *Attorney, Agent, or Firm* — Michael R. Williams; Ryan W. Dupuis; Ade & Company Inc.

(57) ABSTRACT

The main objective of the invention was to develop a new flotation collector that could eliminate or reduce the amount of copper sulfate used in the flotation of sphalerite. Different series of collectors such as cupferrons, arylhydroxamic acids and amino mercaptans or amino thiols were synthesized and tested. Amino mercaptans/aminothiols were found to be very effective in floating sphalerite from a lead-zinc ore using only 10-15% of copper sulfate used with conventional xanthate collector. The present invention does not require any alteration in the current mill practices. This warrants only changing the flotation collector in zinc flotation stage from, for example, potassium amyl xanthate (PAX) to the new collector.

12 Claims, 3 Drawing Sheets

FLOTATION OF SPHALERITE FROM MIXED BASE METAL SULFIDE ORES EITHER WITHOUT OR WITH LARGELY REDUCED AMOUNT OF COPPER SULFATE ADDITION USING 2-(ALKYLAMINO)ETHANETHIOLS AS COLLECTORS

PRIOR APPLICATION INFORMATION

The instant application claims the benefit of U.S. Provisional Patent Application 62/281,872, filed Jan. 22, 2016.

FIELD OF THE INVENTION

The present invention relates to the field of mineral processing. More specifically, the present invention relates to the pre-concentration of zinc ores using forth flotation.

BACKGROUND OF THE INVENTION

Froth flotation is a pre-concentration process extensively used in processing low-grade ores. Effective pre-concentration operations concentrate most of the valuable mineral into a small mass and thus reduce equipment sizes, chemical consumption and material handling in subsequent stages. In the current industrial practice of concentrating lead-zinc ores using froth flotation, first a lead mineral (galena) is pre-concentrated in stage-1 as lead-rougher (Pb-R) and then in the subsequent stage (Stage-2) the zinc mineral (sphalerite) is concentrated as the zinc-rougher (Zn-R). In order to avoid any sphalerite coming into the Pb-R stage, it is suppressed by adding reagents such as sodium metabisulfite (MBS), sodium cyanide and zinc sulfate. Galena, the lead mineral, is floated using potassium ethyl xanthate (PEX) as the collector. After floating galena, sphalerite suppressed in the Pb-R stage is activated by copper sulfate and then floated using potassium amyl xanthate.

Copper sulfate not only activates the sphalerite suppressed in the Pb-R stage but also facilitates the formation of a more stable surface complex with the xanthate collector, thereby enabling its flotation into the froth.

The amount of copper sulfate added depends on the grade of sphalerite in the ore. Generally, about 1 kg of copper sulfate is added per tonne of ore. Hence, a mill processing about 20,000 tonnes of ore per day requires 20 tonnes of copper sulfate. It is of note that zinc in minerals does not form a stable surface complex with xanthates. Consequently, xanthates by themselves are not capable of floating the zinc minerals effectively.

Copper ions in copper sulfate added for activation attach to the zinc sites and form a stable surface complex with the xanthate collector and thus, copper sulfate performs a dual action of activating suppressed sphalerite and forming a more stable surface complex with xanthate.

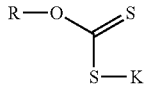

Generic structure of xanthates.

It is very important to keep the pyrite (the gangue mineral) in the tailings rather than co-floating into the float concentrate. Pyrite contamination in the zinc float concentrate reduces the value of the concentrate and renders it commercially less profitable.

Among the auxiliary chemicals used in a flotation circuit, copper sulfate is the most expensive and corrosive. The corrosive nature of copper sulfate reduces the useful life of machinery. Also, the presence of copper makes mill effluents toxic, meaning that expensive effluent-treatment is needed before discharge. Furthermore, the shelf-life of xanthates is limited due to their decomposition in moist environments, and auto-decomposition of xanthates produces harmful volatile substances such as carbon disulfide. Finally, the copper sulfate is unrecoverable for re-use or recycling and ends up in the effluents.

SUMMARY OF THE INVENTION

According to a first aspect of the invention, there is provided a method for flotation of zinc-containing ore for mixed base metal ore comprising:

grinding a quantity of mixed base metal ore, said mixed base metal ore comprising lead-zinc ore and/or copper-zinc ore adding water and a frothing agent to the ground ore, thereby forming a ground ore solution;

adding a lead collector solution and/or a copper collector solution;

collecting floated lead ore and/or copper ore from the ground ore solution;

adding a zinc collector, said zinc collector having a chemical structure according to compound (6):

Compound (6)

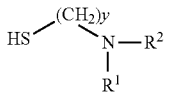

wherein:

$R^1$=H, $R^2$=alkyl, aryl, alkoxy; or $R^1$=alkyl, aryl, alkoxy; $R^2$=H; or $R^1$=$R^2$=alkyl; and y=2 or 3; and collecting the zinc-containing ore.

In some embodiments, $R^1$ and/or $R^2$ is a $C_2$-$C_{12}$ alkyl, aryl or alkoxy, where appropriate. In other embodiments, $R^1$ and/or $R^2$ is a $C_2$-$C_9$ alkyl, aryl or alkoxy, where appropriate.

According to a further aspect of the invention, there is provided use of a zinc collector compound, said compound comprising a chemical structure according to compound (6):

Compound (6)

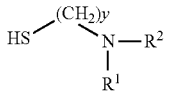

wherein:

$R^1$=H, $R^2$=alkyl, aryl, alkoxy; or $R^1$=alkyl, aryl, alkoxy; $R^2$=H; or $R^1$=$R^2$=alkyl; and y=2 or 3 for flotation of a zinc-containing ore.

In some embodiments, $R^1$ and/or $R^2$ is a $C_2$-$C_{12}$ alkyl, aryl or alkoxy, where appropriate. In other embodiments, $R^1$ and/or $R^2$ is a $C_2$-$C_9$ alkyl, aryl or alkoxy, where appropriate.

DESCRIPTION OF THE PREFERRED EMBODIMENTS

Figure 1:
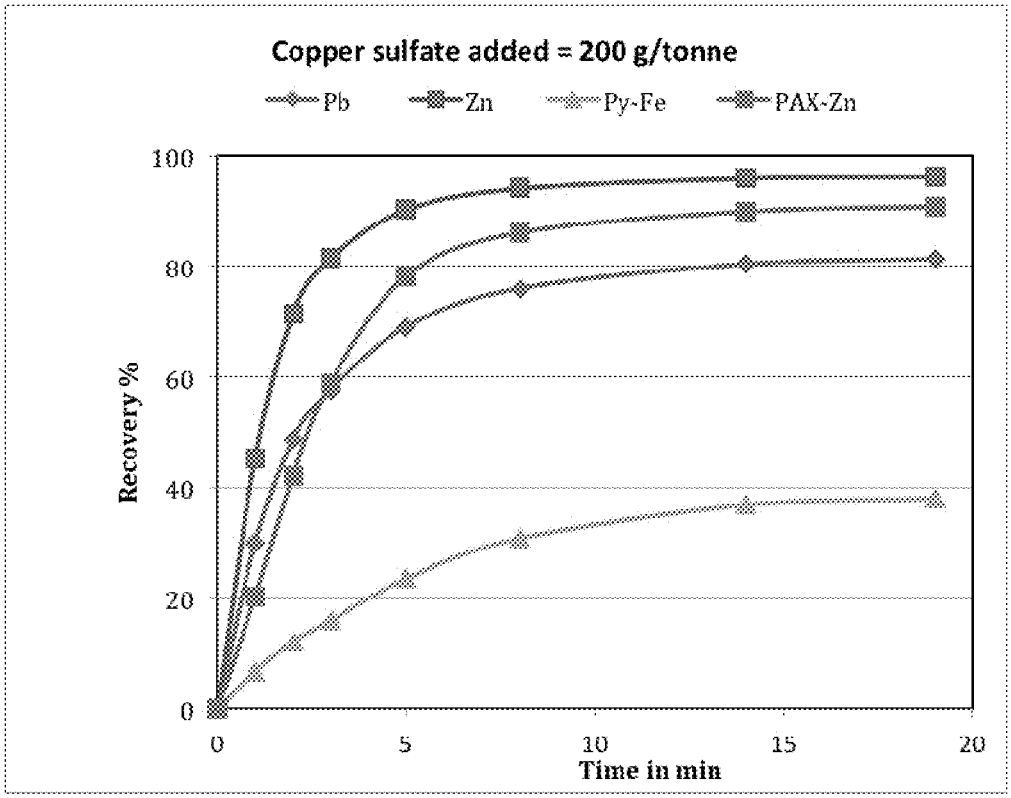
FIG. 1: Time-recovery plot using 200 g copper sulfate added per tonne.

Unless defined otherwise, all technical and scientific terms used herein have the same meaning as commonly understood by one of ordinary skill in the art to which the invention belongs. Although any methods and materials similar or equivalent to those described herein can be used in the practice or testing of the present invention, the preferred methods and materials are now described. All publications mentioned hereunder are incorporated herein by reference.

Flotation is universally used to concentrate minerals from low-grade ores into smaller mass. For sulfide base-metal ores, such as the lead-zinc sulfide or copper-zinc sulfide ores, xanthates are used as flotation collectors. In such ores, lead (or copper) minerals are floated first and zinc minerals are suppressed. Xanthates are not effective for floating zinc minerals such as sphalerite. Therefore, after floating lead (or copper), the addition of copper sulfate is essential to activate the flotation of sphalerite. Copper sulfate is the most expensive auxiliary chemical in the flotation circuit, as discussed above.

Described herein is a new flotation collector that floats zinc minerals without needing copper sulfate. The new collector is very selective for zinc and does not float much pyrite. Specifically, described herein are chemical alternatives to the xanthates. The results, discussed below, indicate that the addition of copper sulfate is either completely eliminated or drastically reduced to less than 10-20% of the usual amount needed. This is unavoidable because of the suppression of zinc minerals in the earlier flotation of lead (or copper).

According to an aspect of the invention, there is provided a method for flotation of zinc-containing ore for mixed base metal ore comprising:

grinding a quantity of mixed base metal ore, said mixed base metal ore comprising lead-zinc ore and/or copper-zinc ore;

adding water and a frothing agent to the ground ore, thereby forming a ground ore solution;

adding a lead collector solution and/or a copper collector solution;

collecting floated lead ore and/or copper ore from the ground ore solution;

adding a zinc collector, said zinc collector having a chemical structure according to compound (6):

Compound (6)

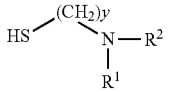

wherein:

$R^1$=H, $R^2$=alkyl, aryl, alkoxy; or $R^1$=alkyl, aryl, alkoxy; $R^2$=H; or $R^1$=$R^2$=alkyl; and y=2 or 3; and collecting the zinc-containing ore.

In some embodiments, $R^1$ and/or $R^2$ is a $C_2$-$C_{12}$ alkyl, aryl or alkoxy, where appropriate. In other embodiments, $R^1$ and/or $R^2$ is a $C_2$-$C_9$ alkyl, aryl or alkoxy, where appropriate.

The zinc collector may have a chemical structure according to compound (5):

Compound (5)

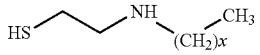

wherein x is an integer.

In some embodiments, x may be an integer between 2 and 12, for example, 2, 3, 4, 5, 6, 7, 8, 9, 10, 11 or 12. In other embodiments, x may be an integer between 2 and 9, for example, 2, 3, 4, 5, 6, 7, 8 or 9. In some embodiments, x may be 2, 3, 5 or 9.

In some embodiments, as discussed below, the zinc collector is in the form of a water-soluble salt, for example, an amine salt, although other suitable salts known in the art may also be used within the invention.

Alternatively, other modifications and/or substitutions may be to any of the compounds as set forth above that improves the solubility of the zinc collector compound in water. Such modifications likely to improve the solubility without affecting the zinc binding can be determined by one of skill in the art through routine experimentation and are accordingly considered to be within the scope of the invention.

In some embodiments, as discussed below, the zinc collector is added in amount of at least 300 g/tonne of ore.

As discussed below, in some embodiments, the pH of the ground ore solution is adjusted to below 7 prior to adding the lead collector or a copper collector solution. For example, the pH may be between about 6 and about 7 or the pH may be about 6.

In some embodiments, copper sulfate may be added in an amount of 100 g/tonne of ore to the ground ore solution to improve the zinc recovery process, as discussed below.

According to another aspect of the invention, there is provided a zinc collector compound, said compound comprising a chemical structure according to compound (6):

Compound (6)

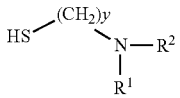

wherein:

$R^1$=H, $R^2$=alkyl, aryl, alkoxy; or $R^1$=alkyl, aryl, alkoxy; $R^2$=H; or $R^1$=$R^2$=alkyl; and y=2 or 3, for flotation of a zinc-containing ore.

In some embodiments, $R^1$ and/or $R^2$ is a $C_2$-$C_{12}$ alkyl, aryl or alkoxy, where appropriate. In other embodiments, $R^1$ and/or $R^2$ is a $C_2$-$C_9$ alkyl, aryl or alkoxy, where appropriate.

In other embodiments, the zinc collector has a chemical structure according to compound (5):

Compound (5)

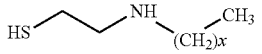

wherein x is an integer.

In some embodiments, x is an integer between 2 and 12, for example, 2, 3, 4, 5, 6, 7, 8, 9, 10, 11 or 12. In other embodiments, x is an integer between 2 and 9, for example, 2, 3, 4, 5, 6, 7, 8 or 9. In some embodiments, x is 2, 3, 5 or 9.

A Quantitative Structure Activity Relationships modeling approach using calculated molecular descriptors was extensively used to select a few potential chemicals for testing from a virtual database containing thousands of chemicals.[1] The approach was used to select arylhydroxamic acids for the flotation of zinc ores. Continuation of the efforts in finding a collector for zinc minerals lead to the selection of 2-(alkylamino)thiols for the flotation of sphalerite without the use of activation by copper sulfate as is otherwise necessary in the popular xanthate flotation schemes currently followed throughout the world.

The basic molecular structure or the chemical class was decided based on the study of zinc co-ordination sites in various biological molecules such as zinc finger proteins. In most of the cases zinc is bound to at least an amine (—$NH_2$) group and a thiol (—SH) group. Hence, amino thiol skeleton was chosen as the potential candidate for selective flotation of zinc minerals.

We synthesized two compounds and used two additional compounds that are available from Sigma Aldrich. The molecular structures are given below:

(1)

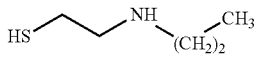

(2)

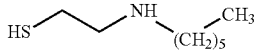

(3)

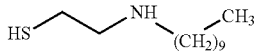

(4)

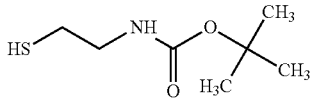

Compound (1) and compound (4) were purchased from Sigma Aldrich. Compound (2) and compound (3) were synthesized. As discussed herein, compound (1) gave the best results.

Compound (2) and compound (3) produced similar but not identical results. While not wishing to be bound to a particular theory or hypothesis, we believe that the issue is the lower water solubility of these compounds, as water solubility decreases with an increase in molecular chain length.

Surprisingly, compound (4) did not perform well. Again, while not wishing to be bound to a particular theory or hypothesis, it is believed that this is due to the crowding near the mineral-collector binding site. Specifically, the group —O—($C(CH_3)_3$) is a bulky group that could create steric hindrance for surface chelation.

Compounds 1-3 may be represented by a common structure:

Compound (5)

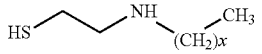

wherein "x" is an integer . . . . In some embodiments, "x" is an integer between 2 and 9. In yet other embodiments, x is 2, 3, 5 or 9.

Alternatively, the N-alkylaminothiol collector may be represented as follows:

Compound (6)

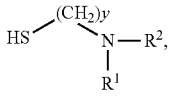

wherein:

$R^1$=H, $R^2$=alkyl, aryl, alkoxy; or $R^1$=alkyl, aryl, alkoxy; $R^2$=H; or $R^1$=$R^2$=alkyl; and y=2 or 3.

In some embodiments, $R^1$ and/or $R^2$ is a $C_2$-$C_{12}$ alkyl, aryl or alkoxy, where appropriate. In other embodiments, $R^1$ and/or $R^2$ is a $C_2$-$C_9$ alkyl, aryl or alkoxy, where appropriate.

As discussed herein, compounds 1, 2, 3, 5 and 6 can be used for flotation of zinc-containing sulfide and oxide ores as well as other ores containing zinc.

The invention will now be further elucidated by way of examples. However, the invention is not necessarily limited by the examples.

Example 1—Material Used

Ore

A lead-zinc ore containing lead as galena (6-8%), zinc as sphalerite (20-22%), iron as pyrite (7-9%) and the remaining as silica (sand) was used in the study.

Auxiliary Chemicals

Sodium cyanide 1% (w/w) in water;

Sodium metabisulfite (MBS) 1% (w/w) in water; Zinc sulfate 1% (w/w) in water; Copper sulfate 10% (w/w) in water;

Potassium ethyl xanthate (PEX) 1% (w/w) in water; Potassium amyl xanthate (PAX) 1% (w/w) in water; Methyl isobutyl carbinol (MIBC) 0.1% (w/w) in water; Lime (pH modifier) in water.

Example 2—Methods

Synthesis of Amino Thiols 2-(Alkylamino)ethanethiols of general formula $RNHCH_2CH_2SH$ are possible to be synthesized by three general methods. The first one involves the reaction of 2-(alkylamino)ethyl halides with the hydrosulfides of the alkali metals[2,3]. Another method is based on the nucleophilic substitution of the 2-(alkylamino)ethyl halides with thiourea followed by an alkaline hydrolysis of the isothiouronium salts[4,5] and the last method is the mercaptoethylation of the primary and the amines with ethylene sulfide[6-8] or other mercaptoethylating agents such as ethyl 2-hydroxyethylthiol-carbonate[8-10], ethyl 2-mercaptoethylcarbonate[9-11] and ethylenemonothiolcarbonate[12]. Another method of mercaptoethylation using ethylene sulfide is outlined by Brand and Vahrenkamp[13]. In the present invention, 2-(alkylamino)

ethanethiols were synthesized by two procedures known in the art. The two procedures are explained for the synthesis of a typical compound.

Procedure 1: Synthesis of 2-(octylamino)ethanthiol

Octylamine (11.5 g; 90 mL) in 40 mL toluene was taken in a round-bottomed flask and heated under reflux. Ethylene sulfide (4.5 g, 75 mmol) in 100 mL toluene was added slowly through a separating funnel over a period of one hour. The reaction mixture was then refluxed for twenty hours. The solution was cooled and the toluene with any unreacted ethylene sulfide was removed by boiling under reduced pressure using a flash evaporator. The resultant product was cleaned by passing through a short column of silica gel.

Procedure 2: Synthesis of 2-(otcylamino)ethanthiol

To a stirring solution of 15.5 g of triethylamine in 75 mL water, silver nitrate solution (12 g in 20 mL water) was added slowly. Black silver oxide was formed. Octyl amine (11.9 g) was added to the solution over a period of five minutes. Ethylene sulfide (5 g) was slowly added to the reaction mixture and the temperature rose from 25° C. to 40° C. The mixture became yellow, indicating the formation of a silver complex. The resulting solid was broken with a glass rod and stirred for two hours. The silver complex was filtered off and washed with distilled water. The solid was suspended in 100 mL water and hydrogen sulfide gas was passed from a Kipp's apparatus with vigorous stirring. After thirty minutes the precipitated silver sulfide was filtered off and the solid was washed with ethanol. The washings were collected with the filtered solution and evaporated in a flash evaporator. The residue was treated with 100 mL water and extracted with ether. Evaporation of the ether layer gave 2-(octylamino)ethanethiol.

Some of the 2-(alkylamino)ethanethiols are commercially available as such or as their ammonium salt. These chemicals are:

1) 2-Aminoethanethiol hydrochloride: CAS Number: 156-57-0
2) 2-(Butylamino)ethanethiol: CAS Number: 5842-00-2
3) tert-Butyl N-(2-mercaptoethyl)carbamate: CAS Number: 67385-09-5
4) 2-(octylamino)ethanethiol hydrochloride: No CAS Number available Example 3—Flotation Tests As discussed herein, the usual process followed by us was as follows. The ore was ground in a polyurethane-lined rod mill at 67% solids so that the rod mill discharge was 80% less than 53 μm just prior to flotation. 10 mL of sodium metabisulfite solution and 10 mL of zinc sulfate solution were added during grinding. A prefloat was collected for five minutes using 10 mL of 1% methyl isobutyl carbinol (MIBC) frother. After the prefloat, the pH was adjusted to neutral (7 to 7.2). 5 mL of sodium cyanide solution and additional 5 mL of zinc sulfate solution were added to the pulp. Then 10 mL of 1% potassium ethyl xanthate (PEX) collector solution was added and the pulp was conditioned for one minute. Lead ore was floated as lead-rougher (Pb-R) after adding 10 mL MIBC solution and opening air at the flow rate of 3 L/min for 5 minutes. After the Pb-R stage, the copper sulfate solution (12 mL) was added and the pulp was conditioned for 1 min. This was followed by the addition of 10 mL of the potassium amyl xanthate (PAX) collector solution and the pulp was again conditioned for one minute. Sphalerite was then floated as the zinc rougher (Zn-R) using 10 mL MIBC frother and 3 L/min air. The float concentrate and the tails samples from each test were filtered, dried, weighed, carefully homogenized, and their representative samples were acid-digested, and were analyzed through Inductively Coupled Argon Plasma Spectrometry (ICAP).

In the instant invention, the above procedure was adhered to for collecting the lead-rougher, i.e., lead-rougher was collected with potassium ethyl xanthate (PEX), but potassium amyl xanthate (PAX) was replaced with the inventive compound/compounds at the concentrations and pH values mentioned below. Furthermore, except for the use of the new compounds, all materials were prepared in ordinary tap water, as is done in the mills, and in concentrations used in the industry.

Example 4—Results a) Four 2-(alkylamio)ethanthiols were tested and among them 2-(buylamino)ethanethiol gave the best results.

b) Compound (1) gave the best results at pH 6.

| pH | Zinc recovery % | Zinc grade |
|---|---|---|
| 6 | 25.7 | 43.5 |
| 7 | 10.3 | 36.1 |
| 8 | 7.6 | 30.2 |
| 9 | 2.5 | 26.7 |
| 10 | 3.3 | 32.6 |
| 10.5 | 1.5 | 28.1 |

The tests were carried out using only 55 μL of the 2-(butylamino)ethanethiol for 350 g of ore.

c) Collector concentration of 300 g/tonne was found to be most optimal for effective flotation of sphalerite.

| Collector concentration (g/tonne of ore) | Zinc recovery % | Pyrite-iron recovery % |
|---|---|---|
| 200 | 41.8 | 45.6 |
| 300 | 70.2 | 59.9 |
| 400 | 73.8 | 59.3 |
| 500 | 84.3 | 47.0 |

As there is no significant difference between 300 g/tonne and 400 g/tonne d) Different amounts of copper sulfate from 100 g/tonne to 400 g/tonne were tested and 200 g/tonne gave the best zinc recovery with low pyrite recovery.

e) Though there is no significant difference in the zinc recovery on adding various amounts of copper sulfate, the selectivity for sphalerite increased with an increase in amount of copper sulfate added. 200 g/tonne was found to give the best zinc recovery at 95.8% with overall sphalerite grade of 45% containing about 3% pyrite.

| Copper sulfate added (g/tonne of ore) | Zinc recovery % | Pyrite-iron recovery % |
|---|---|---|
| 0 | 70.2 | 59.9 |
| 100 | 84.8 | 46.2 |
| 200 | 95.8 | 39.1 |
| 300 | 95.3 | 36.4 |

Addition of copper sulfate increased the zinc recovery and improved the grade of the float (lower amount of pyrite in the float concentrate). Significantly, addition of copper sulfate at more than 200 g/tonne does not improve the zinc recovery and there is no significant suppression of pyrite.

f) The 2-(alkylamino)ethanethiols synthesized and tested in the invention are more selective for zinc than pyrite.

g) The recovery and grade are comparable or slightly better than those obtained using conventional potassium amyl xanthate collector with 1 kg of copper sulfate per tonne of ore in the zinc-rougher stage.

Figure 2:
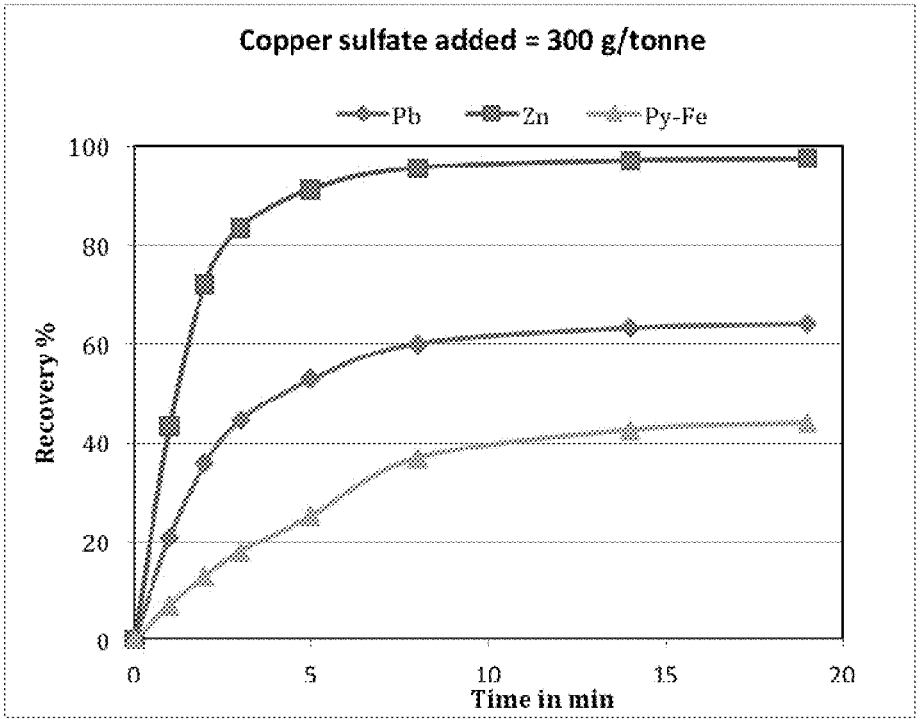
FIG. 2: Time recovery plot using 300 g copper sulfate per tonne.
Figure 3:
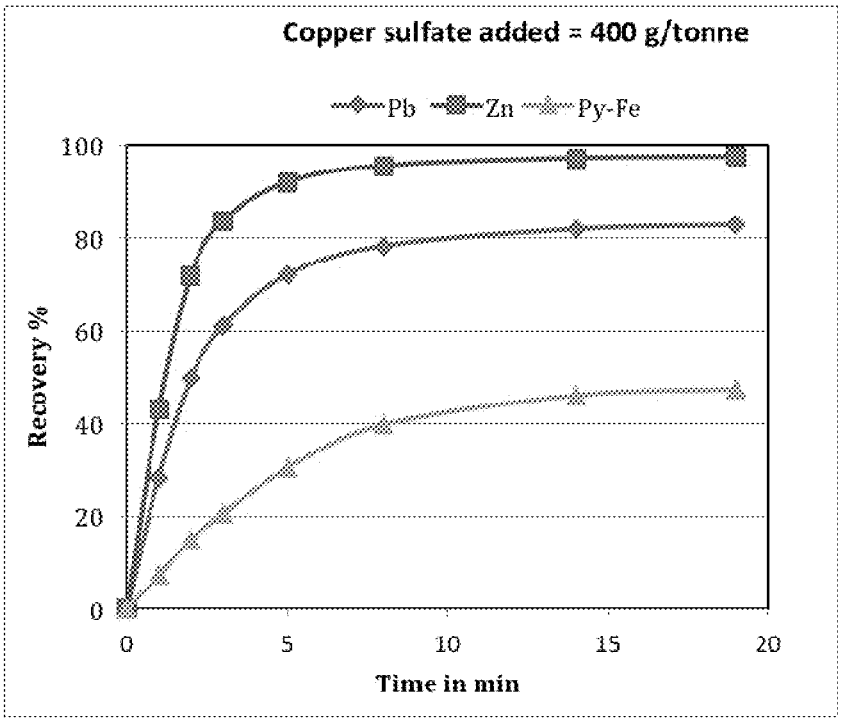
FIG. 3: Time recovery plot using 400 g copper sulfate per tonne.

In order to understand the selectivity of the new collectors, flotation kinetics were studied for the zinc-rougher stage by collecting float concentrates at various time intervals. The results are usually plotted as time vs recovery (%). Zinc recovery obtained under similar conditions on using potassium amyl xanthate (PAX) and 1 kg of copper sulfate per tonne of the ore was lower. The time-recovery plots obtained for the use of three different copper sulfate concentrations are shown in FIGS. 1-3.

Using the flotation kinetics data, a Selectivity Index between sphalerite and pyrite is calculated for the three amounts of copper sulfate addition. Selectivity index for a collector is the ratio of modified rate constant ($K_m$) for valuable mineral to that for gangue mineral and modified rate constant ($K_m$) is the product of rate constant (k) for flotation kinetics and the maximum recovery at infinite time ($R_\infty$)[1]. The results are given in the Table below:

| Copper sulfate added (g/tonne) | $K_m$ for Sphalerite | $K_m$ for Pyrite | Selectivity Index |
|---|---|---|---|
| 200 | 62.9 | 7.1 | 8.80 |
| 300 | 61.8 | 7.9 | 7.79 |
| 400 | 62.0 | 9.4 | 6.62 |

The results clearly show the higher selectivity for sphalerite at 200 g/tonne and the selectivity is sacrificed on adding more copper sulfate. Hence, a small amount of copper sulfate is enough to reactivate the zinc ore suppressed in the lead-rougher stage.

h) The new collector effectively floats sphalerite (zinc) from a mixed base metal sulfide ore such as a lead-zinc or a copper-zinc ore without compromising the recovery and grade using only 20% of copper sulfate required for conventional PAX collector in the zinc-rougher stage.

i) The compounds are also able to float sphalerite effectively from a copper-zinc sulfide ore without activation by copper sulfate. There is no significant difference in the zinc recovery on adding copper sulfate.

The scope of the claims should not be limited by the preferred embodiments set forth in the Examples but should be given the broadest interpretation consistent with the description as a whole.

REFERENCES

1. Natarajan, R. (2013) Hydroxamic acids as chelating mineral collectors. In: Hydroxamic acids unique class of chemical with multiple biological activities. S. P. Gupta Ed., Springer, pp 281-308.
2. Gilman, H.; Plunkett, M. A.; Tolman, L.; Fullhart, L.; Broadbent, H. S. J. Am. Chem. Soc. 1945, 67, 1845.
3. Weijlard, J.; Tishler, M. U.S. Pat. No. 2,642,428 (1953).
4. Albertson, N. F; Clinton, R. 0. J. Am. Chem. Soc. 1945, 67, 1222.
5. Clinton, R. 0.; Salvador, U. J.; Laskowski, S. C.; Suter, C. M. J. Am. Chem. Soc. 1948, 70, 950.
6. Snyder, H. R.; Stewart, J. M.; Ziegler, J. 8. J. Am. Chem. Soc. 1947, 69, 2672.
7. Hansen, 8. Acta Chem. Scand. 1953, 13, 151.
8. Wineman, R. J.; Gollis, M. H.; James, J. C.; Pomponi, A. M. J. Org. Chem. 1962, 27, 4222.
9. Reynolds, D. D.; Fields, D. L.; Johnson, D. L. J. Org. Chem. 1961, 26, 5125. (there are seven parts of this paper in the same issue from Page number 5125 to 5133).
10. Straley, J. M.; Wallace, D. J.; Fisher, J. G. U.S. Pat. No. 3,236,843 (1966).
11. Fields, D. L.; Reynolds, D. D. U.S. Pat. No. 3,335,161 (1967).
12. Reynolds, D. D. U.S. Pat. No. 3,232,936 (1966).
13. Brand, U; Vahrenkamp, H. Inorg. Chem. 1995, 34, 3285.

The invention claimed is:

1. A method for flotation of zinc-containing ore for mixed base metal ore comprising:

grinding a quantity of mixed base metal ore, said mixed base metal ore comprising lead-zinc ore and/or copper-zinc ore;

adding water and a frothing agent to the ground ore, thereby forming a ground ore solution;

adding a lead collector solution and/or a copper collector solution;

collecting floated lead ore and/or copper ore from the ground ore solution;

adding a zinc collector, said zinc collector having a chemical structure according to compound (6):

Compound (6)

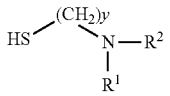

wherein:

$R^1$=H, $R^2$=alkyl, aryl, alkoxy; or $R^1$=alkyl, aryl, alkoxy; $R^2$=H; or $R^1$=$R^2$=alkyl; and y=2 or 3; and collecting the zinc-containing ore.

2. The method according to claim 1 wherein the zinc collector has a chemical structure according to compound (5):

Compound (5)

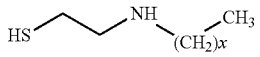

wherein x is an integer between 2 and 12.

3. The method according to claim 2 wherein x is between 2 and 9.

4. The method according to claim 2, wherein x is 2.

5. The method according to claim 2, wherein x is 5.

6. The method according to claim 2, wherein x is 9.

7. The method according to claim 1 wherein the zinc collector is in the form of a water-soluble salt.

8. The method according to claim 1 wherein the zinc collector is in the form of an amine salt.

9. The method according to claim 1 wherein the zinc collector is added in an amount of at least 300 g/tonne of ore.

10. The method according to claim 1 including adjusting the pH of the ground ore solution to below 7 prior to adding the lead collector solution.

11. The method according to claim 1 including adjusting the pH of the ground ore solution to about 6 prior to adding the lead collector solution.

12. The method according to claim 1 including adding copper sulfate in an amount at least 100 g/tonne of ore after addition of the lead collector solution and/or the copper collector solution.

* * * * *